US006487955B1

(12) United States Patent
Nishi

(10) Patent No.: US 6,487,955 B1
(45) Date of Patent: Dec. 3, 2002

(54) PISTON STRUCTURE OF TILT APPARATUS FOR MARINE PROPULSION DEVICE

(75) Inventor: Manabu Nishi, Saitama (JP)

(73) Assignee: Showa Corporation (JP)

( * ) Notice: Subject to any disclaimer, the term of this patent is extended or adjusted under 35 U.S.C. 154(b) by 36 days.

(21) Appl. No.: 09/716,349

(22) Filed: Nov. 20, 2000

(30) Foreign Application Priority Data

Feb. 16, 2000 (JP) ..... 2000-038732

(51) Int. Cl.[7] ..... F15B 13/04
(52) U.S. Cl. ..... 91/422
(58) Field of Search ..... 91/422; 137/533.13, 137/533.19

(56) References Cited

U.S. PATENT DOCUMENTS 2,462,580 A * 2/1949 Watson ..... 91/365
4,091,839 A * 5/1978 Donner ..... 137/533.13
4,363,629 A * 12/1982 Hall et al. ..... 440/61

FOREIGN PATENT DOCUMENTS

JP 5694010 7/1981 ..... F15B/15/22

* cited by examiner

*Primary Examiner*—Edward K. Look
*Assistant Examiner*—Michael Leslie
(74) *Attorney, Agent, or Firm*—Orum & Roth

(57) ABSTRACT

A tilt apparatus for a marine propulsion device structure having a piston constituting a cylinder apparatus with a shock blow valve and a return valve, the return valve attaching a valve body to a return hole provided in the piston, and a valve body holding device provided in the return hole.

6 Claims, 7 Drawing Sheets

PRIOR ART

PISTON STRUCTURE OF TILT APPARATUS FOR MARINE PROPULSION DEVICE

BACKGROUND OF THE INVENTION

1. Field of the Invention

The present invention relates to a piston structure of a tilt apparatus for a marine propulsion device.

2. Description of the Related Art

Conventionally, there has been a tilt apparatus for a marine propulsion device structured such that a cylinder apparatus is interposed between a hull side and a propulsion unit side. The piston constituting the cylinder apparatus has a shock blow valve and a return valve. In this tilt apparatus, when an impact force in an extending direction is applied to the cylinder apparatus due to a collision with, for example, drift wood against the propulsion unit, the shock blow valve is opened at a set pressure so as to transfer a working fluid in a rod side oil chamber of the cylinder apparatus to a piston side oil chamber, thereby extending the piston rod and displacing the propulsion unit up. The return valve is opened due to pressure in the piston side oil chamber increased under operation of a dead load of the propulsion unit after absorbing the impact force, which returns the working oil mentioned above transferred through the piston side oil chamber to the rod side oil chamber, thereby returning the propulsion unit to its original position.

However, in the prior art, as shown in FIG. 9, when assembling a piston 2 in a piston rod 1, a ball 4 of a return valve is installed to a return hole 3 provided in the piston 2. Next the piston 2 is reversed so as to insert a ball, a valve seat and a valve spring of a shock blow valve (not shown) into a shock blow hole (not shown) provided in the piston 2. The piston 2 is attached to the piston rod 1 via a washer 5, and further fixed to the piston rod 1 via a washer 6 by a nut 7. Then, in order to prevent the ball 4 installed to the return hole 3 from falling down driving reversal of the piston 2 mentioned above, the structure is made such that a ball holding pin 8 is inserted to a horizontal hole crossing to the return hole 3 provided in the piston 2. Reference numeral 9 denotes an O-ring provided on an outer periphery of the piston 2.

In this case, in the prior art, in order to make the tilt apparatus compact, it is necessary to make the cylinder apparatus compact, so that it is necessary to make a diameter of the piston 2 small and a size thereof short.

The prior art has the following problems.

(1) Both the shock blow valve and the return valve are arranged with the piston 2. The O-ring 9 is provided on the outer periphery of the piston 2. Since the piston 2 is provided with the large-diameter shock blow hole to which the ball, the valve seat and the valve spring constituting the shock blow valve are inserted, it is necessary to prevent the diameter of the piston 2 from being increased. An O-ring groove 9A in a fixed thickness portion in an outer peripheral side of the piston 2 is formed so that the O-ring groove 9A is required to be formed in a thick portion above the shock blow valve (in a side of the rod side oil chamber). Then, unless the ball holding pin 8 is set further above the O-ring groove 9A (in a side of the rod side oil chamber), the oil in the piston side oil chamber leaks to the rod side oil chamber from a gap of the ball holding pin 8, whereby it is impossible to keep the piston position. As mentioned above, when the O-ring groove 9A is provided above the shock blow valve of the piston 2 and the ball holding pin 8 is provided further above the O-ring groove 9A, it is impossible to prevent the piston 2 from being extended in an axial direction, and it is impossible to make the piston 2 short.

(2) When the horizontal hole for the ball holding pin 8 is provided in the piston 2, it is necessary to apply a drilling process to the horizontal hole, and a spot facing and flattening process to a worked surface of the horizontal hole, whereby the number of processes is increased.

(3) The operation of inserting the ball holding pin 8 to the horizontal hole of the piston 2 is simple but can not be rapidly performed, so that the efficiency of assembly is deteriorated. The position of the horizontal hole must be determined by the operator with each new piece.

SUMMARY OF THE INVENTION

An object of the present invention is to provide a piston structure of a tilt apparatus for a marine propulsion device in which a piston is compact while preventing a return valve from falling off during assembly of a valve body. A further object is to improve workability and ease of assembly of the piston.

In accordance with the present invention, there is provided a piston structure of a tilt apparatus for a marine propulsion device structured such that a cylinder apparatus is installed between a hull side and a propulsion unit side. A piston constituting the cylinder apparatus has a shock blow valve and a return valve, wherein the return valve attaches a valve body to a return hole provided in the piston, and valve body holding means is provided in the return hole.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

DESCRIPTION OF THE PREFERRED EMBODIMENT

First Embodiment (FIGS. 1 to 5)

Figure 1:
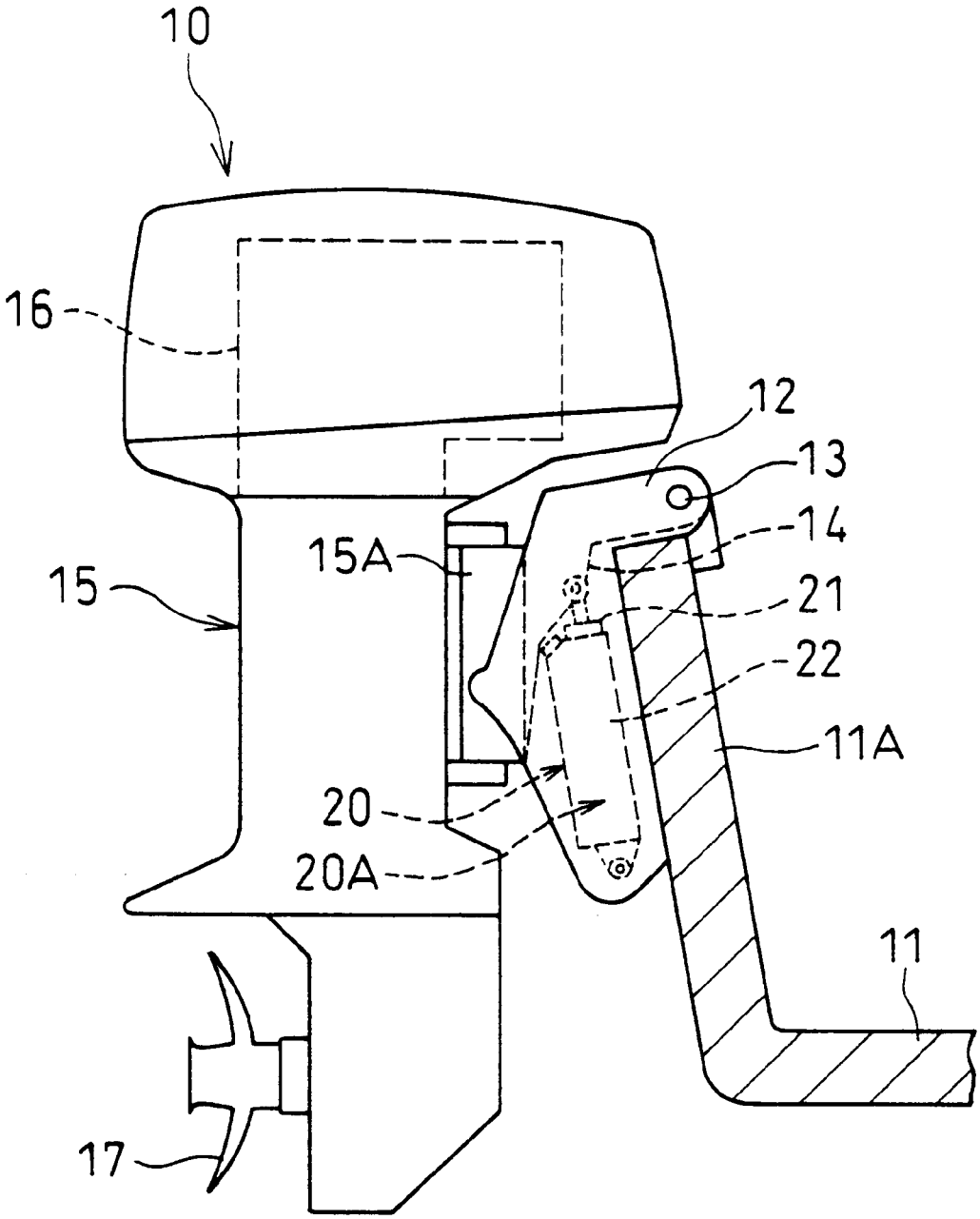
FIG. 1 is a schematic view showing a marine propulsion device.

A marine propulsion device 10 (an outboard engine, however, an inboard outboard engine may be available) is structured as shown in FIG. 1. A stern bracket 12 is fixed to a stern plate 11A of a hull 11 and a swivel bracket 14 is pivoted to the stern bracket 12 via a tilt shaft 13 so as to be freely tilted around a substantially horizontal axis. A propulsion unit 15 is pivoted to the swivel bracket 14 via a substantially vertically arranged rudder shaft (not shown) so as to be rotatable around the rudder shaft. An engine unit 16 is mounted to an upper portion of the propulsion unit 15, and a propeller 17 is provided in a lower portion of the propulsion unit 15.

That is, the marine propulsion device 10 is structured such that the propulsion unit 15 is supported by the stern bracket 12 fixed to the hull 11 via the tilt shaft 13 and the swivel bracket 14 in a freely tilting manner. A cylinder apparatus 21 of a power unit 20A constituting a tilt apparatus 20 is interposed between the stern bracket 12 and the swivel bracket 14. A working fluid is controlled to be supplied or discharged from a working fluid supply and discharge apparatus 22 of the power unit 20A to the cylinder apparatus 21, thereby extending and contracting the cylinder apparatus 21 so as to make the propulsion unit 15 freely tilting.

Figure 2:
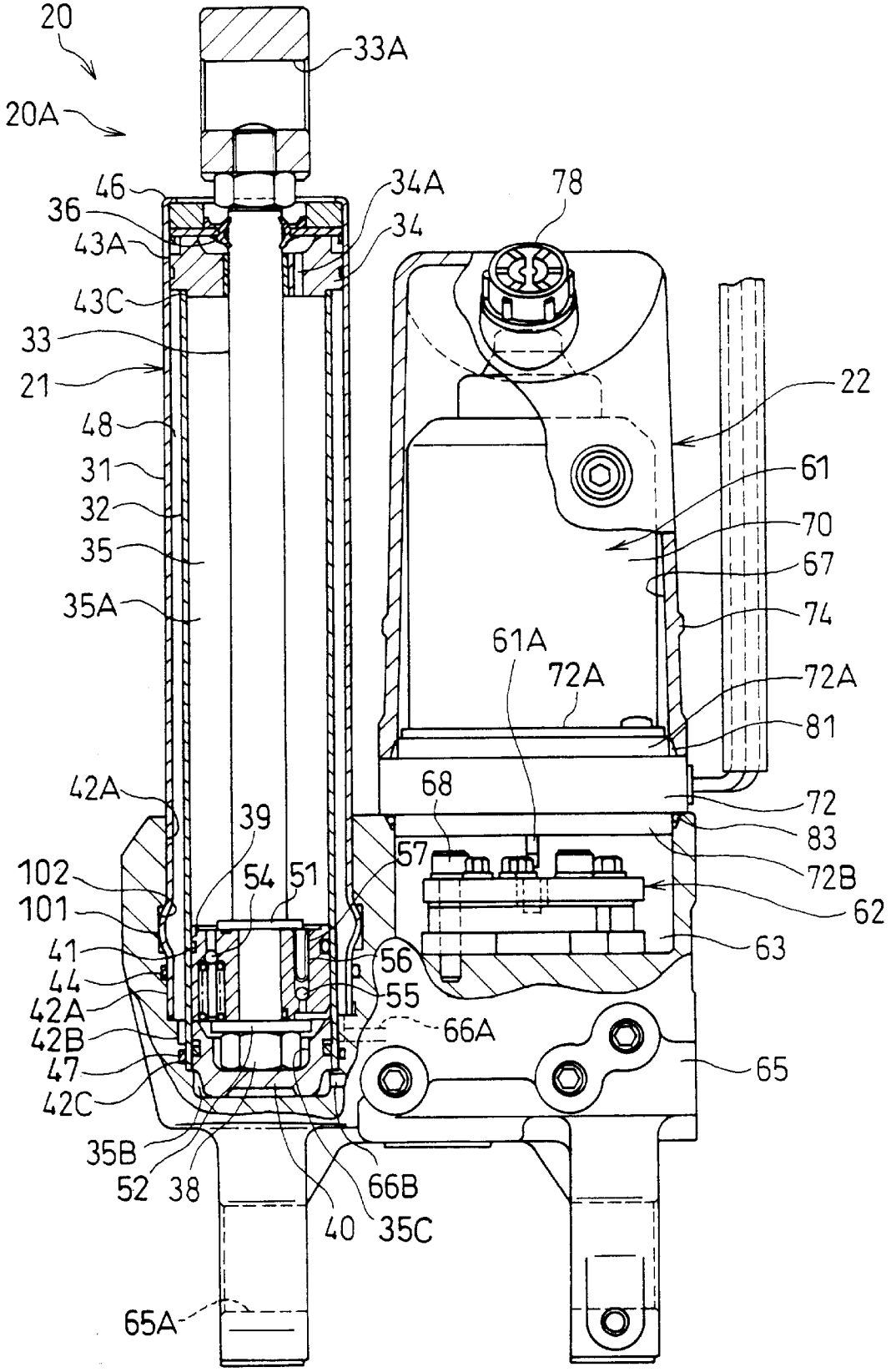
FIG. 2 is a front elevational view showing a power unit in a partly cutaway manner.
Figure 3:
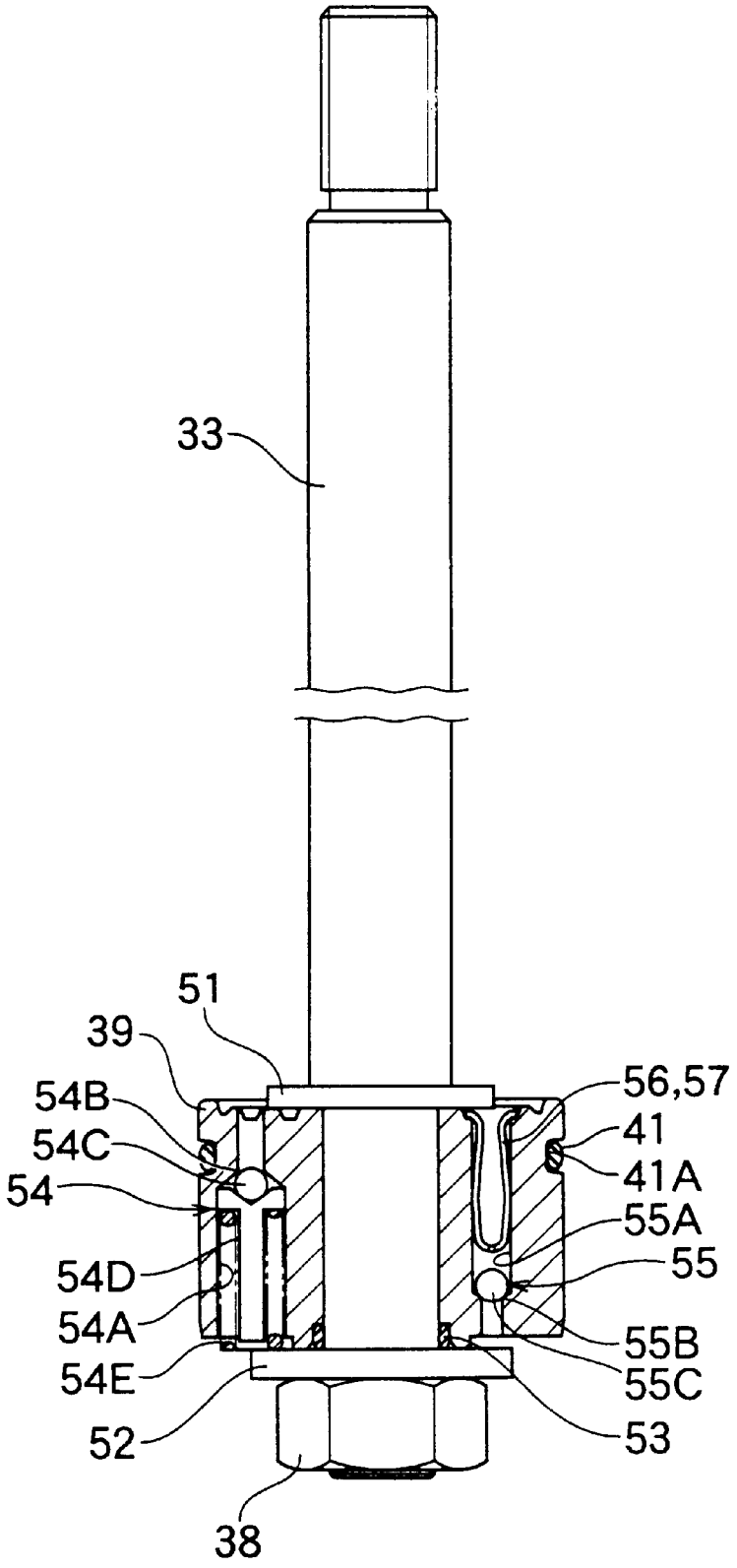
FIG. 3 is a cross sectional view showing a piston in accordance with a first embodiment.
Figure 4:
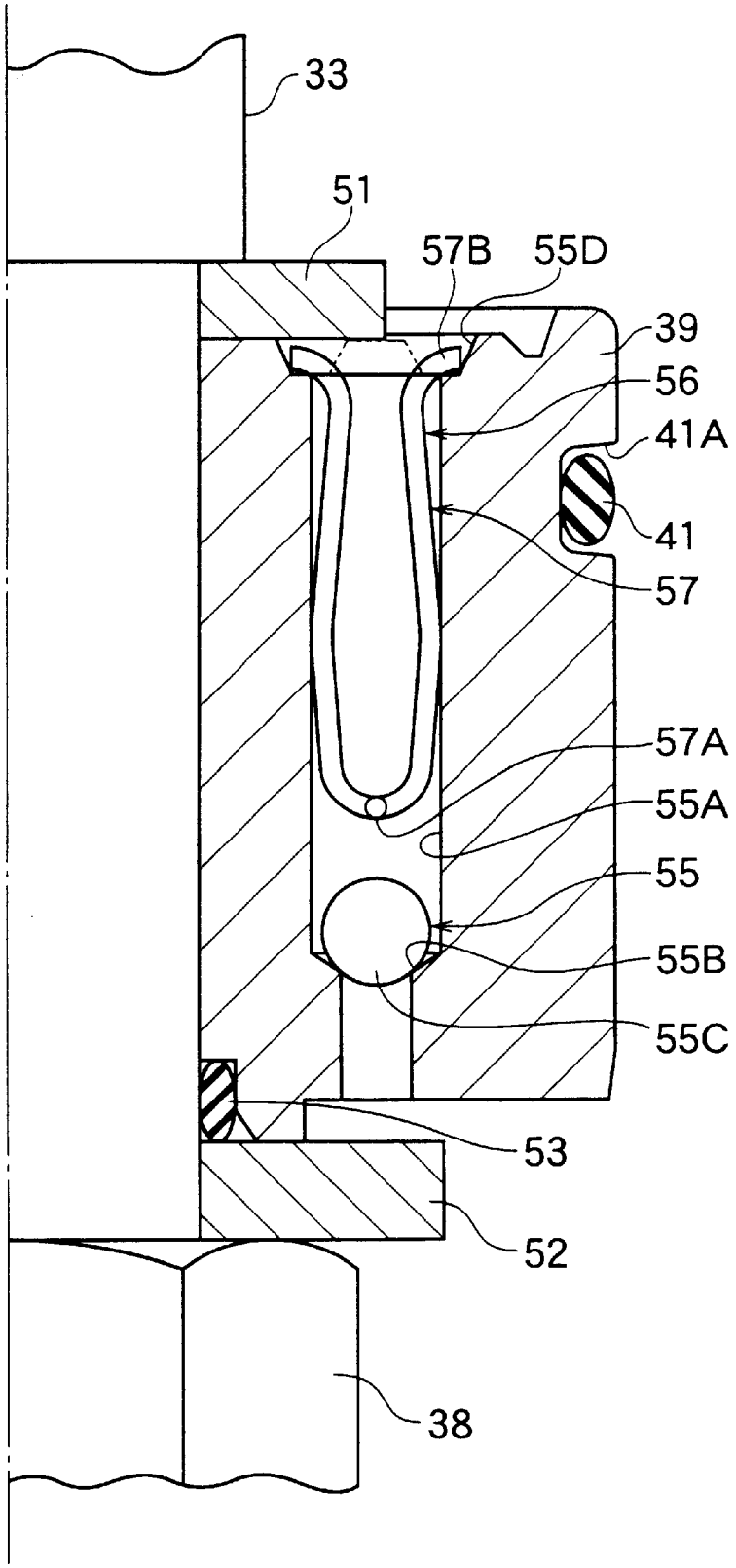
FIG. 4 is an enlarged cross sectional view of a main portion in FIG. 3.

Cylinder Apparatus 21 (FIG. 2)

The cylinder apparatus 21 (FIG. 2) of the power unit 20A constituting the tilt apparatus 20 is structured to be integrally connected to a valve block 65, mentioned below, of the working fluid supply and discharge apparatus 22. That is, the cylinder apparatus 21 has an outer cylinder 31 and an inner cylinder 32 constituted by a draw molded steel pipe which integrally connects the cylinders 31 and 32 with the valve block 65. In this case, the valve block 65 is formed, for example, by a casting of an aluminum alloy, and is provided with a mounting pin attaching hole 65A to the stern bracket 12.

Further, the cylinder apparatus 21 has a piston rod 33 connected to the swivel bracket 14. The piston rod 33 is inserted in a tilt chamber 35 of the inner cylinder 32. A rod guide 34 provided in an open end of the outer cylinder 31 allows the piston rod 33 to be freely extended and contracted. The rod guide 34 is provided with a seal member 36 slidably in contact with the piston rod 33. The piston rod 33 is provided with a mounting pin attaching hole 33A to allow attachment to the swivel bracket 14. The rod guide 34 is provided with an oil hole 34A for communicating a back surface of the seal member 36 with a tilt chamber 35.

The cylinder apparatus 21 has a piston 39 fixed to an end portion of the piston rod 33 within the tilt chamber 35 of the inner cylinder 32 by a nut 38. The piston 39 is provided with an O-ring 41 slidably in contact with an inner surface of the inner cylinder 32 which sections the tilt chamber 35 into a first tilt chamber 35A (a rod side oil chamber) in a side of receiving the piston rod 33 and a second tilt chamber 35B (a piston side oil chamber) in a side of not receiving the piston rod 33. A detailed structure of the piston 39 will be later described.

In this case, the cylinder apparatus 21 has a free piston 40 nearly in contact with the piston 39 in the second tilt chamber 35B.

The cylinder apparatus 21 is provided with a large-diameter hole 42A, a middle-diameter hole 42B and a small-diameter hole 42C which are formed in a coaxial manner in the valve block 65, and is provided with a large-diameter portion 43A and a small-diameter portion 43C which are formed in a coaxial manner in the rod guide 34. One end portion of the outer cylinder 31 is fitted to the large-diameter hole 42A of the valve block 65 via an O-ring 44, and another end portion of the outer cylinder 31 is fitted to the large-diameter portion 43A of the rod guide 34 and fixed by a caulked portion 46. One end portion of the inner cylinder 32 is fitted to the small-diameter hole 42C of the valve block 65 via an O-ring 47, and another end portion of the inner cylinder 32 is fitted to the small-diameter portion 43C of the rod guide 34 so as to be fixed thereto. Accordingly, a ring-space-like oil passage 48 is formed between the outer cylinder 31 and the inner cylinder 32, thereby communicating the first tilt chamber 35A with the oil passage 48 by an oil passage 49 open to the inner cylinder 32 (or a communicating flow passage 49A provided in the rod guide 34) (not shown). The oil passage 48 communicating with the first tilt chamber 35A is communicated with a first oil passage 66A communicated with the middle-diameter hole 42B of the valve block 65, and the second tilt chamber 35B is communicated with a second oil passage 66B provided in the valve block 65, respectively.

A structure connecting the cylinder apparatus 21 to the valve block 65 can be achieved by providing a ring groove 102 formed in a circular arc shape or a rectangular shape in a cross section of the large-diameter hole 42A of the valve block 65, inserting one end portion of the outer cylinder 31 into the large-diameter hole 42A, expanding one end portion of the outer cylinder 31 in accordance with a bulging process so as to form a bulge portion 101, and engaging the bulge portion 101 with the ring groove 102 mentioned above.

Working Fluid Supply and Discharge Apparatus 22 (FIG. 2)

The working fluid supply and discharge apparatus 22 of the power unit 20A constituting the tilt apparatus 20 is constituted by a reversible motor 61, a reversible gear pump 62, a tank 63 and a flow passage with a switching valve 64 (not shown). The working fluid supply and discharge apparatus can supply and discharge the working fluid to and from the first tilt chamber 35A and the second tilt chamber 35B in the cylinder apparatus 21 via the first oil passage 66A and the second oil passage 66B provided in the valve block 65.

The working fluid supply and discharge apparatus 22 forms the fluid passage with the switching valve 64 (not shown) by the valve block 65 made of an aluminum alloy casting, and is provided with the first oil passage 66A, the second oil passage 66B and the like. The valve block 65 is provided with the large-diameter hole 42A, the middle-diameter hole 42B and the small-diameter hole 42C for integrally forming the cylinder apparatus 21 in the manner mentioned above, and is provided with the tank 63 (a main tank) at a position closely in contact with the integrally connecting portion of the cylinder apparatus 21. The tank 63 receives the working fluid and is provided with the pump 62 submerged into the working fluid. The pump 62 is fixed to the valve block 65 by a bolt 68.

Accordingly, the working fluid supply and discharge apparatus 22 is structured such that the motor 61 for driving the pump 62 is arranged in an upper portion of the tank 63 provided in the valve block 65, and a reservoir 67 (a sub tank) is constituted by a reservoir housing 74 covering the motor 61. Then, the motor 61 is structured to fix an end plate 72 to a lower end opening portion of an iron yoke 70 by a fastening screw while fitting the end plate 72 thereto via a seal member such as an O-ring or the like in a fluid-tight manner. Step portions 72A and 72B in upper and lower portions of the end plate 72 fit an around portion of the tank 63 of the valve block 65 to the lower step portion 72B, seal the tank 63 by an O-ring 83 in a fluid-tight manner, fit the reservoir housing 74 to the upper step portion 72A, seal by an O-ring 81 in a fluid-tight manner, and fasten the reservoir housing 74 and the end plate 72 to the valve block 65 by a bolt (not shown). An output shaft 61A of the motor 61 extends through the end plate 72 in a fluid-tight manner and is connected to a driven shaft of the pump 62. In this case, the reservoir 67 and the tank 63 are communicated with each other via a communicating passage provided in the end plate 72 of the motor 61. Reference numeral 78 denotes a cap attached to an oil charging hole of the reservoir housing 74.

Accordingly, a tilt operation of the tilt apparatus 20 is as follows.

(1) Tilt down

When normally rotating the motor 61 and the pump 62, the discharge oil of the pump 62 is supplied to the first tilt chamber 35A of the cylinder apparatus 21, and the working fluid in the second tilt chamber 35B is returned to the pump 62 so as to contract the cylinder apparatus 21, thereby tilting the apparatus down.

(2) Tilt up

When reverse rotating the motor 61 and the pump 62, the discharge oil of the pump 62 is supplied to the second tilt chamber 35B of the cylinder apparatus 21, and the working fluid in the first tilt chamber 35A is returned to the pump 62 so as to extend the cylinder apparatus 21, thereby tilting the apparatus up.

Accordingly, in the marine propulsion device 10, the piston 39 is constituted in the manner mentioned below.

The piston 39 is fixed to the end portion of the piston rod 33 via upper and lower washers 51 and 52 by the nut 38 mentioned above, as shown in FIGS. 3 and 4. At this time, the piston 39 is provided with the O-ring 53 attached with respect to the piston rod 33 on an inner periphery thereof, and is provided with the O-ring 41 in slidable contact with the inner periphery of the inner cylinder 32 in a ring groove 41A on an outer periphery. Further, the piston 39 has a shock blow valve 54 and a return valve 55.

The shock blow valve 54 is structured such that a valve seat 54B is provided in a shock blow hole 54A provided in the piston 39. A ball 54C, a valve seat 54D and a valve spring 54E seated on the valve seat 54B are inserted to the shock blow hole 54A, and the valve spring 54C is back-up supported by the washer 52. The shock blow valve 54 is opened at a set pressure when an impact force in an extending direction is applied to the cylinder apparatus 21 due to a collision with, for example drift wood, against the propulsion unit 15 or the like, so as to transfer the working fluid in the first tilt chamber 35A to a free piston chamber 35C between the piston 39 and the free piston 40, thereby extending the piston rod 33 and displacing the propulsion unit 15.

The return valve 55 is structured such that a valve seat 55B is provided in a return hole 55A provided in the piston 39 and a ball 55C (a valve body) seated in the valve seat 55B is inserted to the return hole 55A. The return valve 55, opened due to a pressure in the free piston chamber 35C increased under operation of a dead load of the propulsion unit 15 after absorbing the impact force due to the operation mentioned above of the shock blow valve 54, can return the working oil mentioned above transferred to the free piston chamber 35C to the first tilt chamber 35A, and can place the propulsion unit 15 to a position before displacing up. At this time, the free piston 40 mentioned above stays at a fixed position before and after the absorption of the impact force mentioned above. This allows an amount of the fluid transferred to the free piston chamber 35C from the first tilt chamber 35A via the shock blow valve 54 to be equal to an amount of the fluid transferred to the first tilt chamber 35A from the free piston chamber 35C via the return valve 55, thereby securely coinciding a returning position of the piston rod 33 in the cylinder apparatus 21 after absorbing the impact with a position before absorbing the impact.

Figure 5A:
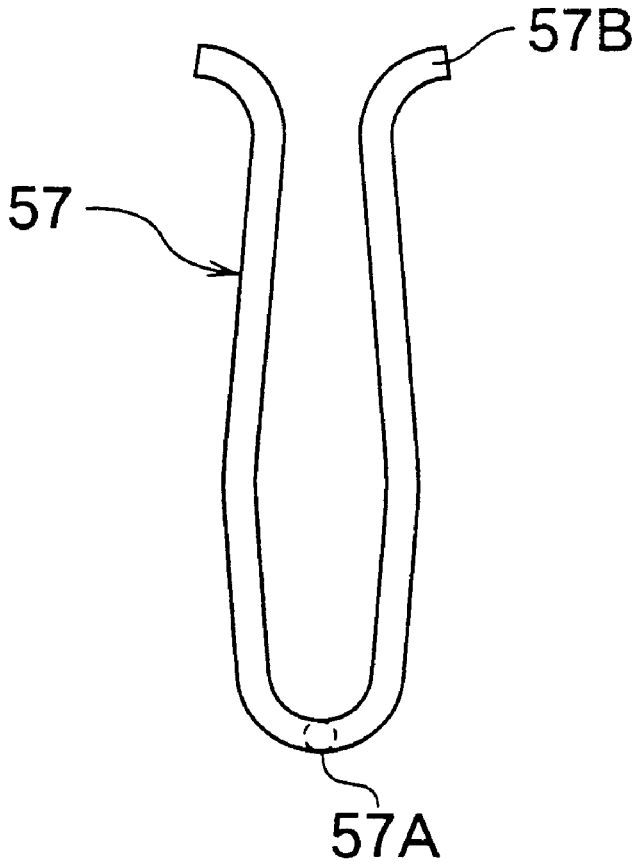
FIGS. 5A and 5B are perspective views showing a valve body holding device.
Figure 5B:
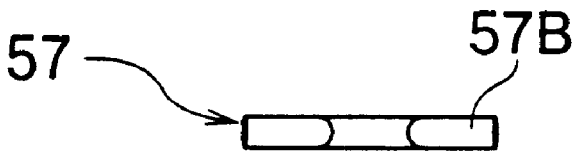

Further, the return valve 55 attaches a valve body holding device 56 to the return hole 55A provided in the piston 39 so as to prevent the ball 55C from falling out during assembly of the piston 39. The valve body holding device 56 is a U-shaped pin 57 as shown in FIG. 5, which is inserted to the return hole 55A from a front end round portion 57A of the U-shaped pin 57. U-shaped pin 57 bent portions 57B and 57B expand to outer portions of both ends with a bevel-like step portion 55D provided in the opening portion of the return hole 55A, and is prevented from being taken out in an assembled state by the washer 51 partly covering the return hole 55A. The U-shaped pin 57 sections the front end round portion 57A from the ball 55C on the valve seat 55B at a fixed distance so as to allow a valve opening operation of the ball 55C. In this case, the U-shaped pin 57, made of an elastic material such as a spring steel, a resin or the like, is made a little greater in a maximum width in a free state of U-shape than the hole diameter of the return hole 55A. The U-shaped pin 57 is inserted to the return hole 55A in a state of being elastically narrowed in width due to a comparatively light bending force, and is in pressure contact with the return hole 55A due to an elastically returning force, whereby it is possible to prevent the pin from being taken out in an assembling step. The pressure contact force mentioned above between the U-shaped pin 57 and the return hole 55A required for preventing removal during the assembly step is sufficient to be small enough to support a falling down weight of the ball 54C, so that the spring force mentioned above narrowing the U-shaped pin 57 for inserting the U-shaped pin 57 to the return hole 55A is sufficiently light. In one embodiment, the piston 39 can be formed by a sintered body, or through a sintering process and in this case, it is possible to simultaneously form the return hole 55A and the step portion 55D mentioned above.

A procedure for assembling the piston 39 is as follows:

(1) The ball 55C is inserted to the return hole 55A of the piston 39 and next the U-shaped pin 57 is inserted to the return hole 55A. The bent portion 57B of the U-shaped pin 57 is engaged with the step portion 55D in the opening portion of the return hole 55A. The U-shaped pin 57 is in pressure contact with the return hole 55A due to the elastic restoring force mentioned above of the U-shaped width to prevent removal, thereby holding the ball 55C.

(2) The piston 39 is turned over, and the ball 54C, the valve seat 54D and the valve spring 54E are inserted to the shock blow hole 54A of the piston 39. During turning over of the piston 39, the U-shaped pin 57 in the item (1) mentioned above prevents the ball 55C from being taken out from the return hole 55A.

(3) The piston 39 is inserted and attached to the piston rod 33 via the washer 51 and further fixed thereto via the washer 52 by the nut 38. The bent portion 57B of the U-shaped pin 57 is [in a state of being] securely prevented from being taken out by the washer 51.

In accordance with the present embodiment, the following effects can be obtained:

(1) Since the valve body holding device 56 (the U-shaped pin 57) is provided in the return hole 55A constituting the return valve 55 of the piston 39, it is possible to prevent the ball 55C from being taken out even when turning over the piston 39 after assembling the ball 55C.

(2) Since the valve body holding device 56 (the U-shaped pin 57) is provided in the return hole 55A itself, it is not necessary to increase the size and a length of the piston 39 in comparison with the structure in which the pin inserting horizontal hole is provided above the O-ring groove 41A on the outer periphery of the piston 39. In the piston 39, the O-ring groove 41A can be formed in the thick portion without increasing the diameter of the piston 39 by forming the O-ring groove 41A in the thick portion above the shock blow valve 54, whereby it is possible to make the diameter of the piston 39 small. Accordingly, it is possible to make the piston 39 compact by making the diameter and the size of the piston 39 small and short.

(3) Since the valve body holding device 56 (the U-shaped pin 57) is provided by utilizing the return hole 55A itself of the piston 39, no additional process is required relating to the piston 39, and it is possible to reduce the number of the processes. In the case that the piston 39 is constituted by a sintered material, it is possible to easily form the shape of the return hole 55A in a shape proper for receiving the valve body holding device 56 (the U-shaped pin 57).

(4) Since the operation of providing the valve body holding device 56 (the U-shaped pin 57) in the return hole 55A in the piston 39 is applied to the same hole as that of the operation of assembling the ball 55C in the return hole 55A in the same direction, efficiency of assembling is improved.

(5) Since the valve body holding device 56 (the U-shaped pin 57) is engaged with the step portion 55D of the return hole 55A, the valve body holding device 56 (the U-shaped pin 57) is not deformed within the return hole 55A during the operation of the tilt apparatus 20. The ball 55C is not gripped with respect to the valve seat 55B and [an] inferior operation of the return valve 55 is not caused.

(6) Since a simple shape is employed for the valve body holding device 56 (the U-shaped pin 57), the pin can be easily produced, has an improved attaching property to the return hole 55A and can easily realize the items (1) to (5) mentioned above. It is possible to smoothly start inserting the U-shaped pin 57 from the front end round portion 57A thereof to the return hole 55A. A light bending force for narrowing the width of the U shape is sufficient as mentioned above, and an attaching property to the return hole 55A is improved.

Figure 6:
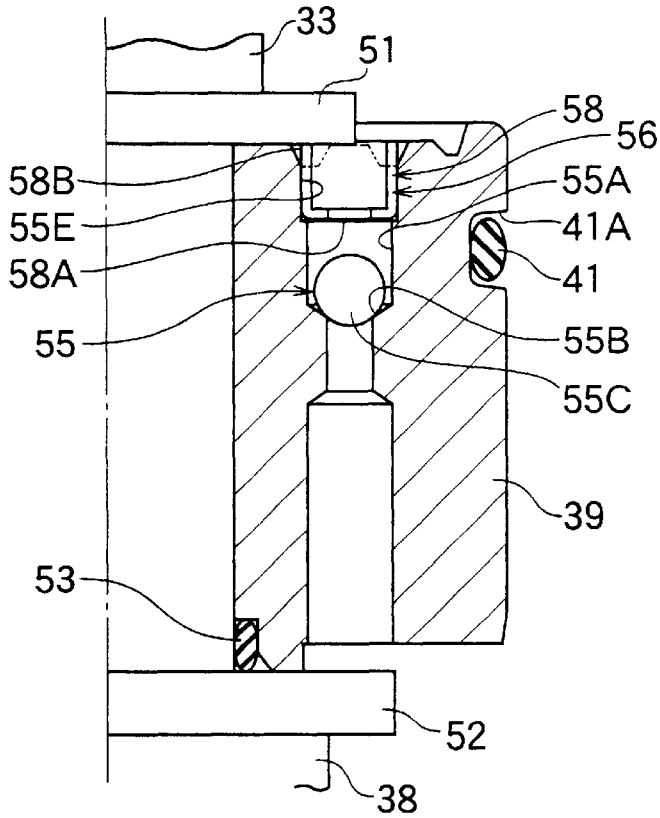
FIG. 6 is an enlarged cross sectional view of a main portion of a piston in accordance with a second embodiment.
Figure 7:
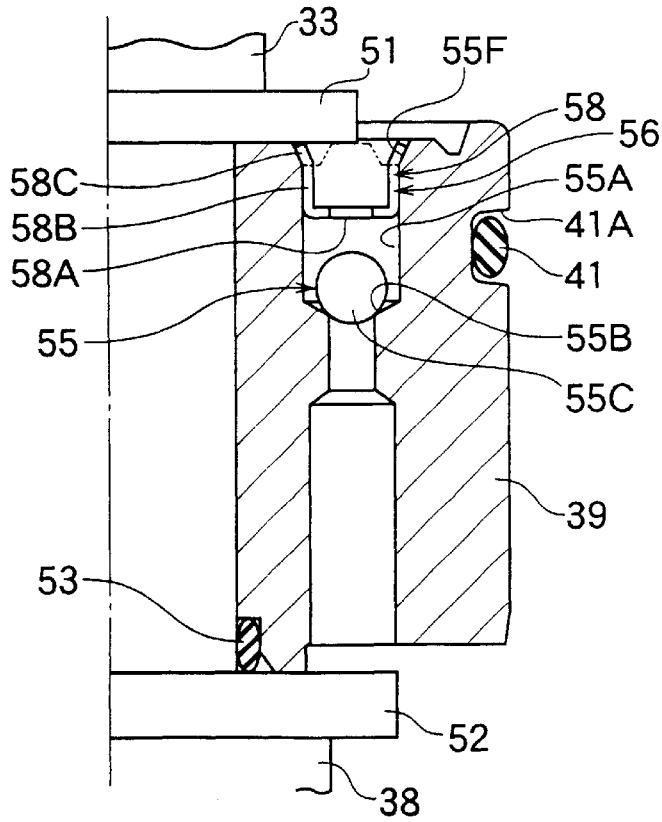
FIG. 7 is an enlarged cross sectional view of a main portion showing a modified embodiment of the structure in FIG. 6.
Figure 8A:
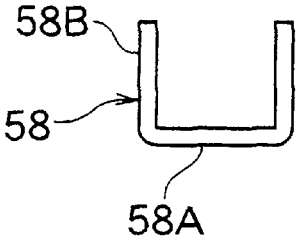
FIGS. 8A and 8B are schematic views showing a valve body holding devices.
Figure 8B:
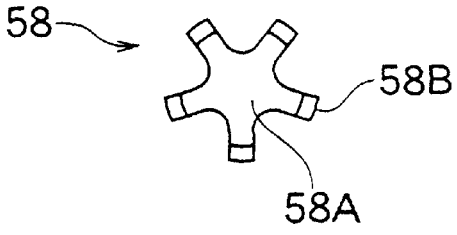
Figure 9:
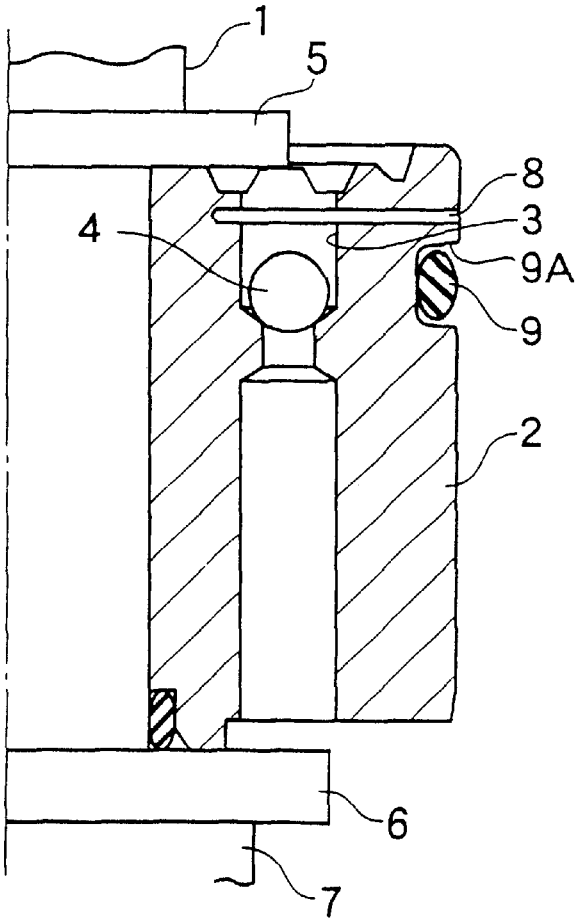
FIG. 9 is an enlarged cross sectional view of a main portion from prior art.

Second Embodiment (FIGS. 6 to 8)

A second embodiment shown in FIG. 6 is different from the first embodiment shown in FIG. 5 in that a cage 58 is employed for the valve body holding device 55. The cage 58 is provided with stand-up pieces 58B at plural positions in the periphery of a front end surface portion 58A, as shown in FIG. 8. The cage 58 is inserted to the return hole 55A from the front end surface portion 58A. The cage 58 is engaged with a large-diameter hole-shaped step portion 55E having a fixed depth and provided with the stand-up pieces 58B in an opening portion of the return hole 55A, and is prevented from being taken out by the washer 51 partly covering the return hole 55A in an assembled state. The cage 58 sections the front end surface portion 58A at a fixed distance from the ball 55C on the valve seat 55B in the assembled state, thereby allowing a valve opening operation of the ball 55C. In this case, the cage 58 is made of an elastic material such as a spring steel, a resin or the like, and is made a little greater in maximum width in a free state of the stand-up piece 58B than a hole diameter of the return hole 55A. The cage is inserted to the return hole 55A in a state of being elastically narrowed in width due to a comparatively light bending force, and is in pressure contact with the return hole 55A due to an elastically returning force, whereby it is possible to prevent the pin from being taken out in an assembling step. The pressure contact force between the cage 58 and the return hole 55A required for preventing removal in the assembly step is sufficient to be small enough to support a falling down weight of the ball 55C, so that a light bending force narrowing the cage 58 for inserting the cage 58 to the return hole 55A is sufficient. Further, the piston 39 can be formed by a sintered body, and in this case, it is possible to simultaneously form the return hole 55A and the step portion 55E mentioned above.

A procedure for assembling the piston 39 is substantially the same as that of the first embodiment.

In accordance with the present embodiment, in addition to the effects of the first embodiment, it is possible to easily produce and improve an attaching property to the return hole 55A by employing the cage 58 having a simple shape for the valve body holding device 56.

A point in which a modified embodiment shown in FIG. 7 is different from the second embodiment of FIG. 6 is that in order to prevent the cage 58 from being deformed within the return hole 55A during an operation of the tilt apparatus 20, a bent portion 58C expanding outward is provided in the end portion of the stand-up piece 58B of the cage 58 and the bent portion 58C is engaged with the bevel-like step portion 55F provided in the opening portion of the return hole 55A.

As heretofore explained, embodiments of the present invention have been described in detail with reference to the drawings. However, the specific configurations of the present invention are not limited to the embodiments but those having a modification of the design within the scope of the appended claims are also included in the present invention. For example, the valve body holding means in accordance with the present invention is not limited to the valve body holding device 56 such as the U-shaped pin 57, the cage 58 or the like as far as the valve body holding means is provided in the return hole of the piston.

As mentioned above, in accordance with the present invention, in the piston structure of the tilt apparatus for the marine propulsion device, it is possible to make the piston compact and improve workability and assembly of the piston while preventing the return valve from being taken out at a time of assembly of the valve body.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A piston structure of a tilt apparatus for a marine propulsion device having a cylinder apparatus disposed between a hull side and a propulsion unit side, and a piston constituting the cylinder apparatus has a shock blow valve and a return valve, said return valve has a valve element attached to a return hole provided in the piston and valve element holding means is disposed in said return hole, said valve element holding means comprises a U-shaped pin attached to the return hole.

2. A piston structure of a tilt apparatus for a marine propulsion device as claimed in claim 1, wherein said valve element holding means has an expanded bent portion arranged and constructed to engage a step portion disposed in an opening portion of the return hole and a washer partly covering the return hole, wherein the holding means is prevented from being taken out by the washer.

3. A piston structure of a tilt apparatus for a marine propulsion device having a cylinder apparatus disposed between a hull side and a propulsion unit side, and a piston constituting the cylinder apparatus has a shock blow valve and a return valve, said return valve has a valve element attached to a return hole provided in the piston and valve element holding means is disposed in said return hole, said valve element holding means comprises a valve element holding device in contact with the return hole, the valve element holding device being engaged with a step portion provided in the return hole, said valve element holding means comprises a U-shaped pin attached to the return hole.

4. A piston structure of a tilt apparatus for a marine propulsion device as claimed in claim 3, wherein said valve element holding means has an expanded bent portion arranged and constructed to engage a step portion disposed in an opening portion of the return hole and a washer partly covering the return hole, wherein the holding means is prevented from being taken out by the washer.

5. A piston structure of a tilt apparatus for a marine propulsion device having a cylinder apparatus disposed between a hull side and a propulsion unit side, and a piston constituting the cylinder apparatus has a shock blow valve and a return valve, said return valve has a valve element attached to a return hole provided in the piston and valve element holding means is disposed in said return hole, said valve element holding means has an expanded bent portion arranged and constructed to engage a step portion disposed in an opening portion of the return hole and a washer partly covering the return hole, wherein the holding means is prevented from being taken out by the washer.

6. A piston structure of a tilt apparatus for a marine propulsion device having a cylinder apparatus disposed between a hull side and a propulsion unit side, and a piston constituting the cylinder apparatus has a shock blow valve and a return valve, said return valve has a valve element attached to a return hole provided in the piston and valve element holding means is disposed in said return hole, said valve element holding means comprises a cage attached to the return hole, said valve element holding means has an expanded bent portion arranged and constructed to engage a step portion disposed in an opening portion of the return hole and a washer partly covering the return hole, wherein the holding means is prevented from being taken out by the washer.

* * * * *